United States Patent [19]

Scheruebl

[11] 4,175,767

[45] Nov. 27, 1979

[54] SKI STRUCTURES

[76] Inventor: Franz Scheruebl, Schwemmberg 117, Radstadt, (Salzburg), Austria

[21] Appl. No.: 859,043

[22] Filed: Dec. 9, 1977

[30] Foreign Application Priority Data

Dec. 10, 1976 [AT] Austria ..... 9131/76

[51] Int. Cl.[2] ..... A63C 5/12

[52] U.S. Cl. ..... 280/610

[58] Field of Search ..... 280/610, 609, 601, 602, 280/603, 607, 606

[56] References Cited

U.S. PATENT DOCUMENTS

| | | | |
|---|---|---|---|
| 2,184,791 | 12/1939 | Broome | 280/610 |
| 2,356,809 | 8/1944 | Andreef | 280/610 |
| 3,329,437 | 7/1967 | Holmberg et al. | 280/610 |
| 3,947,049 | 3/1976 | Pedersen | 280/610 X |

FOREIGN PATENT DOCUMENTS

| | | | |
|---|---|---|---|
| 1118884 | 3/1956 | France | 280/610 |
| 1524339 | 4/1968 | France | 280/610 |
| 2048079 | 3/1971 | France | 280/610 |

*Primary Examiner*—David M. Mitchell
*Assistant Examiner*—Milton L. Smith
*Attorney, Agent, or Firm*—Andrus, Sceales, Starke & Sawall

[57] ABSTRACT

A ski structure has a top chord, a bottom chord, at least one intermediate chord, and core material between the chords. The core material is so shaped or arranged that the or each intermediate chord is at a constant distance from the top chord at the top portion and remote rear end of the ski, and is at a constant distance from the bottom chord in the middle region of the ski.

4 Claims, 3 Drawing Figures

SKI STRUCTURES

BACKGROUND OF THE INVENTION

The invention relates to a ski having a top chord, a bottom chord and a core arranged between them, varying in height over the length of the ski and divided by at least one intermediate chord extending from the toe portion or shovel approximately to the end of the ski.

Known skis which have a so-called sandwich construction consist in cross-section of the following structural elements:

A first layer called the top chord consisting of a stiff or resistant material, for example aluminum or a glass-fiber-reinforced plastic or a combination of these materials, which layer is coated for optical reasons on the top thereof, which forms the upper surface of the ski;

another layer called the bottom chord likewise consisting of a stiff or resistant material, for example of the above-mentioned kinds;

an intermediate layer between the top chord and the bottom chord and called the core, this intermediate layer consisting, for example, of wood, aluminum honeycombs, glass-fiber-reinforced plastic or foamed plastic, and a running sole, for example of polyethylene, which is protected laterally by steel edges.

Vibrations are caused in the ski, in particular through shocks or impacts acting on its toe portion, and are propagated in its longitudinal direction, whereby its running properties are impaired. In order to keep these vibrations as small as possible, it is known to design the ski so that it extensively damps such vibrations.

This has been achieved heretofore by making the top and bottom chords particularly thick, making the core thick, providing rubber inserts in the core or providing rubber inserts between the chords and the core. These expedients may be provided separately or in combination. Thick dimensions for the chords or the core are disadvantageous, however, inasmuch as the ski is thereby given damping properties over its entire length, although this not desirable for its terminal zones.

Damping properties are obtained only in the middle zone of the ski by giving it an increased thickness in its middle zone. This, however, is again disadvantageous because in this way the ski becomes inflexible in the middle zone.

It is furthermore known from French Pat. 2,048,079 to provide between the top chord and the bottom chord an intermediate chord extending in the neutral zone of the ski, by which the properties of stiffness of the ski are improved.

As against this, the object of the present invention is to provide a ski having at least one intermediate chord so that it exhibits improved damping properties against longitudinal vibrations. According to the invention, this is achieved in that the at least one intermediate chord extends in the zones of the toe and heel portions of the ski so that it closely follows the top chord and extends in the middle zone of the ski at a distance from the top chord varying over the length of this zone and at a distance from the bottom chord remaining constant over the length of the said zone.

The core part closely following the top chord is preferably made of harder material than the rest of the core. The at least one intermediate chord may be made of aluminum or glass-fiber-reinforced plastic.

Preferred embodiments of the present invention are described more fully hereinafter with reference to the accompanying drawings.

DETAILED DESCRIPTION OF PREFERRED EMBODIMENTS

Figure 1:
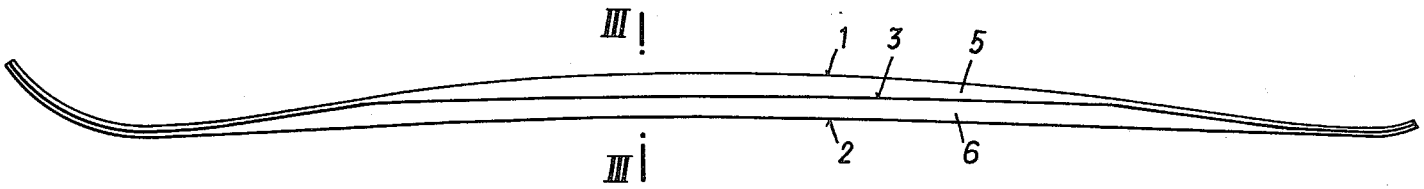
FIGS. 1 and 2 are diagrammatic side views of two skis according to the invention.

The ski shown in FIG. 1 comprises a top chord 1 and a bottom chord 2 between which another chord 3 is arranged. This intermediate chord 3 extends from the front tip of the shovel to the rear end of the ski and divides the core located between the top chord 1 and the bottom chord 2 into an upper core part 5 and a lower core part 6.

Figure 3:
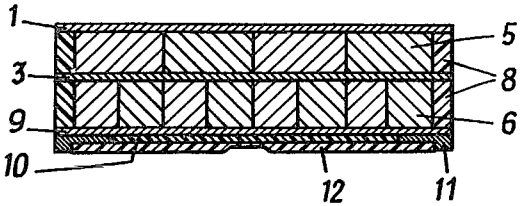
FIG. 3 is a cross-section on a larger scale through the ski of FIG. 1 on the line III—III therein.

FIG. 3 shows the structure of this ski in enlarged cross-section. As can be seen therefrom, the ski comprises a top chord 1, for example of aluminum, an upper core part 5, for example of hardwood, an intermediate chord 3, for example of glass-fiber-reinforced plastic, a lower core part 6, for example of softwood, and a bottom chord formed by a layer 9, for example of aluminum and a layer 10, for example of glass-fiber-reinforced plastic. This is followed by a running surface 12, for example of polyethylene. Steel edges 11 are provided at the sides of the running surface 12. The core parts 5 and 6 may be constructed from laminates or battens or strips. The lateral surfaces of the ski are provided with side pieces 8, for example of molded phenolic resin.

The intermediate chord 3 extends at the toe and heel portions of the ski at a constant distance from the top chord 1 and in the middle zone of the ski at a distance from the top chord 1 varying in a progressively diminishing manner over the length of this zone, and at a distance from the bottom chord remaining constant over the length of the said zone. By reason of the arrangement of the intermediate chord 3, shocks or impacts occurring in particular at the toe of the ski, which subject the bottom chord to a tensile load and the top chord to a compressive load, cause only greatly damped longitudinal vibrations in the ski. The damping is also promoted by employing stronger and , if necessary, specifically heavier material, and consequently material which has a more powerful damping action, for the upper core part 5 than for the lower core part 6. Strong material is moreover also more suitable for fixing the ski binding.

Figure 2:
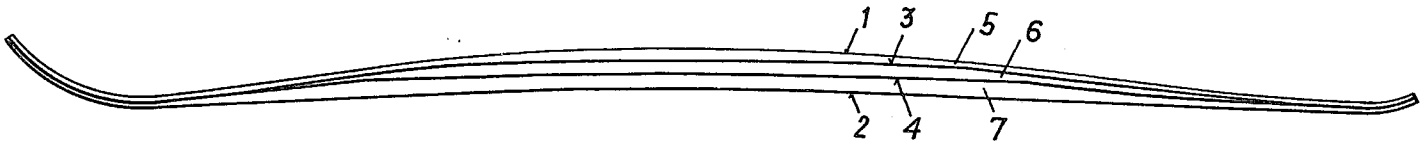

The embodiment according to FIG. 2 differs from the embodiment according to FIG. 1 in that two intermediate chords 3 and 4, for example of glass-fiber-reinforced plastic, with core parts 5, 6 and 7 located therebetween, are provided, the uppermost core part 5 being made, for example, of hardwood and the other two core parts 6 and 7 being made, for example, of softwood. In this case also, the intermediate chords 3 and 4 extend at the toe and heel portions of the ski at a constant distance from the top chord 1 and in the intermediate zone of the ski at a varying distance from the top chord 1 and a constant distance from the bottom chord 2.

The described effects can also be obtained when the intermediate chord or chords or some of them do not extend from the front tip or toe portion of the ski, but begin only at a distance from the toe portion.

As a result of a construction of this kind, the ski consequently shows good vibration-damping properties in its intermediate zone, whereby it ensures a smooth run even with a hard, uneven course. As mentioned, this effect is also based on the fact that the material of the upper core part has a more powerful damping action than the material of the subjacent core part, which, it is true, must have greater tensile strength, but needs to have only a lower specific gravity. Since, moreover, the upper core part, which has a higher weight than the rest of the core, is provided for the major part in the intermediate zone of the ski, the weight of the ski is concentrated in its middle part even more than in the case of known skis, whereby the ski can be turned more easily, that is may be described as particularly ready to turn.

Although certain specific embodiments have been described hereinbefore with reference to the drawings, other embodiments in accordance with the invention as defined by the appended claims can be constructed.

I claim:

1. A ski structure comprising: a top chord of aluminum; an upper core part of hardwood; an intermediate chord of glass-fiber-reinforced plastics material; a lower core part of softwood; a bottom chord comprising an upper layer of aluminum and a lower layer of glass-fiber-reinforced plastics material; a running surface of polyethylene; steel edge means provided at the sides of the said running surface; and molded phenolic resin side pieces arranged to cover the sides of the said core parts; said intermediate chord extending from the front tip of the ski structure to the remote rear end of the ski structure and the said core parts being so shaped that at and adjacent said front tip and said remote rear end said intermediate chord is at a constant distance from said top chord, and in the middle region of said structure said intermediate chord is disposed at a constant distance from said bottom chord and at a distance from said top chord which latter distance diminishes towards the said front tip and said remote rear end.

2. A ski structure comprising:

(a) a top chord, (b) an upper core part disposed adjacent said top chord, (c) a bottom chord having a running surface thereon, (d) a lower core part disposed adjacent said bottom chord, (e) edge means disposed at the sides of said running surface, (f) side pieces disposed to cover the sides of said core parts, (g) and at least one intermediate chord extending from the front tip of the ski structure to the remote rear end of the ski structure, (h) said core parts being so shaped that at and adjacent said front tip and said remote rear end said intermediate chord is at a constant distance from said top chord, and in the middle region of said structure said intermediate chord is disposed at a constant distance from said bottom chord and at a distance from said top chord which latter distance diminishes towards the said front tip and said remote rear end.

3. The ski structure of claim 2 wherein said lower core part is of softer material than said upper core part.

4. A ski structure comprising, in combination:

(a) a top chord, (b) a bottom chord, (c) core means disposed between said top and bottom chords and varying in height lengthwise of the ski structure, (d) at least one intermediate chord dividing said core means longitudinally of the ski structure, (e) the ski structure being shaped to have a toe portion, a middle portion and a heel portion, (f) and at least one intermediate chord disposed closely adjacent and following said top chord at said toe and heel portions and with said chord being spaced by a substantially constant distance from said bottom chord in said middle portion, (g) said intermediate chord being disposed at a distance from said top chord which progressively diminishes towards said toe and heel portions.

* * * * *